US007995027B2

(12) United States Patent
Hong

(10) Patent No.: US 7,995,027 B2
(45) Date of Patent: Aug. 9, 2011

(54) APPARATUS AND METHOD FOR CONTROLLING BACKLIGHT

(75) Inventor: Jion-Iou Hong, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 1014 days.

(21) Appl. No.: 11/846,539

(22) Filed: Aug. 29, 2007

(65) Prior Publication Data

US 2008/0284713 A1 Nov. 20, 2008

(30) Foreign Application Priority Data

May 14, 2007 (TW) ..... 96117004 A

(51) Int. Cl.
*G09G 3/36* (2006.01)

(52) U.S. Cl. ..... 345/102; 345/87

(58) Field of Classification Search ..... 345/102, 345/207, 690, 87–100
See application file for complete search history.

(56) References Cited

U.S. PATENT DOCUMENTS

| | | | | |
|---|---|---|---|---|
| 2007/0152949 | A1* | 7/2007 | Sakai | 345/102 |
| 2007/0216636 | A1* | 9/2007 | Lo | 345/102 |
| 2007/0222740 | A1* | 9/2007 | Hanada | 345/102 |
| 2008/0018571 | A1* | 1/2008 | Feng | 345/87 |
| 2008/0129677 | A1* | 6/2008 | Li et al. | 345/102 |
| 2009/0040171 | A1* | 2/2009 | Ishizumi et al. | 345/102 |
| 2009/0268105 | A1* | 10/2009 | Kohashikawa et al. | 348/790 |

* cited by examiner

*Primary Examiner* — Kimnhung Nguyen
(74) *Attorney, Agent, or Firm* — Jianq Chyun IP Office

(57) ABSTRACT

An apparatus and a method for controlling backlight are provided. The apparatus for controlling backlight is adapted for driving a backlight module of a display panel, and the backlight module includes M luminance-controlling blocks, in which an $i^{th}$ luminance-controlling block corresponds to an $i^{th}$ luminance data. The apparatus for controlling backlight includes a calculation unit and a driving circuit. The calculation unit receives the $i^{th}$ luminance data to output an $i^{th}$ controlling data according to the proportion of the $i^{th}$ luminance data and a maximum luminance data, in which M and i are natural numbers, and i<=M. The driving circuit receives the $i^{th}$ controlling data to determine and drive the backlight luminance of the $i^{th}$ luminance-controlling block.

28 Claims, 8 Drawing Sheets

| | | | | |
|---|---|---|---|---|
| 201 | 202 | 203 | 204 | 205 |
| 206 | 207 | 208 | 209 | 210 |
| 211 | 212 | 213 | 214 | 215 |
| 216 | 217 | 218 | 219 | 220 |
| 221 | 222 | 223 | 224 | 225 |

APPARATUS AND METHOD FOR CONTROLLING BACKLIGHT

CROSS-REFERENCE TO RELATED APPLICATION

This application claims the priority benefit of Taiwan application serial no. 96117004, filed May 14, 2007. All disclosure of the Taiwan application is incorporated herein by reference.

BACKGROUND OF THE INVENTION

1. Field of the Invention

The present invention relates to an apparatus for controlling backlight. More particularly, the present invention relates to an apparatus for controlling backlight, which is adapted for controlling a backlight module including a plurality of luminance-controlling blocks and is advantageous in significantly increasing the image contrast.

2. Description of Related Art

With the advancement of the modern video technology, liquid crystal or plasma displays have been widely used in display screen of consumer electronics products, such as cell phones, notebook computers, personal computers, and personal digital assistants (PDAs). However, since the panel of the liquid crystal or plasma display itself does not have light-emitting function, it is necessary to dispose a backlight source below the panel to provide display light source for the liquid crystal panel. Currently, backlight sources available in the market include plane fluorescent lamps, cold cathode fluorescent lamps (CCFLs), and light emitting diodes (LEDs). As LED has the advantages such as small volumes, free of thermal radiation, low power consumption, long life time, and preferred response speed, and is capable of solving many problems that plane fluorescent lamp and CCFL cannot overcome previously, thus being the backlight source has promising prospect at the present stage.

Taking liquid crystal panel as an example, in the current technique, LEDs serve as the backlight source of the liquid crystal panel in the manner of being full light or full dark. When displaying a frame, LEDs are in a state of being full light, and the liquid crystal panel determines the amount of the light passing through the liquid crystal panel through the rotation angle of the internal liquid crystal molecules. However, if the mount of the light passing through the liquid crystal panel is merely determined by the rotation angle of the liquid crystal molecules, the frame contrast will be limited by the scope of the rotation angle of the liquid crystal molecules, and thus the fineness of the frame is reduced. Additionally, when a part of area in the frame needs a lower luminance, LEDs still serve as the backlight source of the liquid crystal panel in the manner of being full light, thereby causing excessive power wastage.

SUMMARY OF THE INVENTION

Accordingly, the present invention is directed to provide an apparatus for controlling backlight, which provides backlight sources with different luminance respectively to different blocks in a display panel through a plurality of controlling data in a driving circuit, so as to improve the contrast of a frame.

The present invention is directed to provide a method for controlling backlight, which determines backlight luminance of different blocks in the display panel according to controlling data, so as to prevent excessive power wastage.

The present invention provides an apparatus for controlling backlight, which is adapted for driving backlight module in a display panel. The backlight module includes M luminance-controlling blocks, and an $i^{th}$ luminance-controlling block corresponds to an $i^{th}$ luminance data. The apparatus for controlling backlight includes a calculation unit and a driving circuit. The calculation unit receives the $i^{th}$ luminance data, and generates and outputs an $i^{th}$ controlling data according to the proportion of the $i^{th}$ controlling data and the maximum luminance data, in which M and i are natural numbers, and i<=M. The driving circuit receives the $i^{th}$ controlling data to determine and drive the luminance of the $i^{th}$ luminance-controlling block.

The present invention provides a method for controlling backlight luminance, which is adapted for driving a backlight module in a display panel according to M luminance data of the luminance-controlling block. The backlight module includes M luminance-controlling blocks, and an $i^{th}$ luminance-controlling block corresponds to an $i^{th}$ luminance data. The method for controlling backlight luminance includes providing a maximum luminance data; receiving the $i^{th}$ luminance data; generating and outputting an $i^{th}$ controlling data according to the proportion of the $i^{th}$ luminance data and the maximum luminance data, in which M and i are natural numbers, and i<=M; and determining and driving the backlight luminance of the $i^{th}$ luminance-controlling block according to the $i^{th}$ controlling data.

According to the present invention, as a plurality of controlling data is adapted to determine the backlight luminance of various blocks in the display panel, the frame contrast is improved, and excessive power wastage is avoided.

In order to the make aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figures 1, 2:
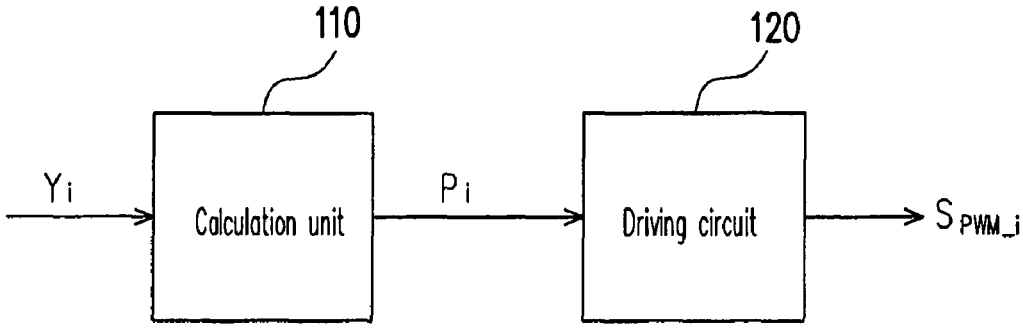
FIG. 1 is a block diagram of an apparatus for controlling backlight according to an embodiment of the present invention.
FIG. 2 is a schematic view of a display frame according to an embodiment of the present invention.

FIG. 1 is a block diagram of an apparatus for controlling backlight according to an embodiment of the present invention. Referring to FIG. 1, an apparatus for controlling backlight 100 includes a calculation unit 110 and a driving circuit 120. In order to illustrate this embodiment, the following assumptions are made in this embodiment, but not intended to limit the present invention. Firstly, the apparatus for controlling backlight 100 is assumed to be adapted for a backlight module of a display panel, and a frame displayed by the display panel is assumed to be divided into M luminance-controlling blocks. The frame displayed by the display panel is, for example, as shown in FIG. 2. FIG. 2 is a schematic view of a display frame according to an embodiment of the present invention. In FIG. 2, the display frame is assumed to be divided into 25 luminance-controlling blocks 201-225, that is, the value of M is, for example, 25. Next, the backlight module of the display panel according to this embodiment is assumed to be composed of a plurality of LEDs corresponding to the 25 controlling blocks, each luminance-controlling block corresponds to one or more LEDs connected in series or in parallel, that is, the backlight module is also divided into 25 luminance-controlling blocks.

Next, assume that each of the 25 luminance-controlling blocks is corresponding to a luminance data. An $i^{th}$ luminance-controlling block corresponds to an $i^{th}$ luminance data, and i is a natural number less than or equal to 25. The luminance data is, for example, obtained from the frame data to be displayed after being processed by front circuits, and the $i^{th}$ luminance data represents an average luminance of the $i^{th}$ luminance-controlling block. Finally, the LEDs in the backlight module are assumed to be driven by pulse width modulation (PWM) signals. That is, the 25 luminance-controlling blocks in this embodiment respectively correspond to 25 PWM signals. The embodiment of FIG. 1 is illustrated hereinafter.

Firstly, the calculation unit 110 in FIG. 1 receives the $i^{th}$ luminance data, which is expressed as $Y_i$. Moreover, the calculation unit 110 will generate an $i^{th}$ controlling data and output the $i^{th}$ controlling data to the driving circuit 120 according to a proportion of the $i^{th}$ luminance data $Y_i$ and a maximum luminance data, in which the $i^{th}$ controlling data is expressed as $P_i$. The maximum luminance data is, for example, the luminance data having the maximum average luminance in the display frame.

The relationship between the $i^{th}$ controlling data $P_i$ and the $i^{th}$ luminance data $Y_i$ is, for example, a linear relationship, and thus, the $i^{th}$ controlling data $P_i$ is expressed, for example, by the following mathematical expression:

$$P_i=P_{max}-(P_{max}-P_{min})\times(Y_{max}-Y_i)/Y_{max}$$

in which, $P_{max}$ indicates the maximum controlling data, $P_{min}$ indicates the minimum controlling data, and $Y_{max}$ indicates the maximum luminance data.

The driving circuit 120 receives the $i^{th}$ controlling data $P_i$, and determines a PWM signal $S_{PWM_i}$ according to the $i^{th}$ controlling data $P_i$, so as to drive the LEDs in the $i^{th}$ luminance-controlling block. As the luminance of the LED is proportional to the duty cycle of the PWM signal, the luminance of the LEDs in the $i^{th}$ luminance-controlling block is controlled by the $i^{th}$ controlling data, such that the $i^{th}$ controlling data controls the luminance of the $i^{th}$ luminance-controlling block.

It should be noted that, though a possible mode of determining the apparatus for controlling backlight has been described in the above embodiment, those of ordinary skills in the art should understand that, manufacturers have different designs on the display panel and the backlight module, and thus the application of the present invention should not be limited by this possible mode. That is to say, as long as the frame is divided into a plurality of luminance-controlling blocks, and each block is driven by different signals, so that various luminance-controlling blocks have different luminance, the spirit of the present invention is met.

Figure 3:
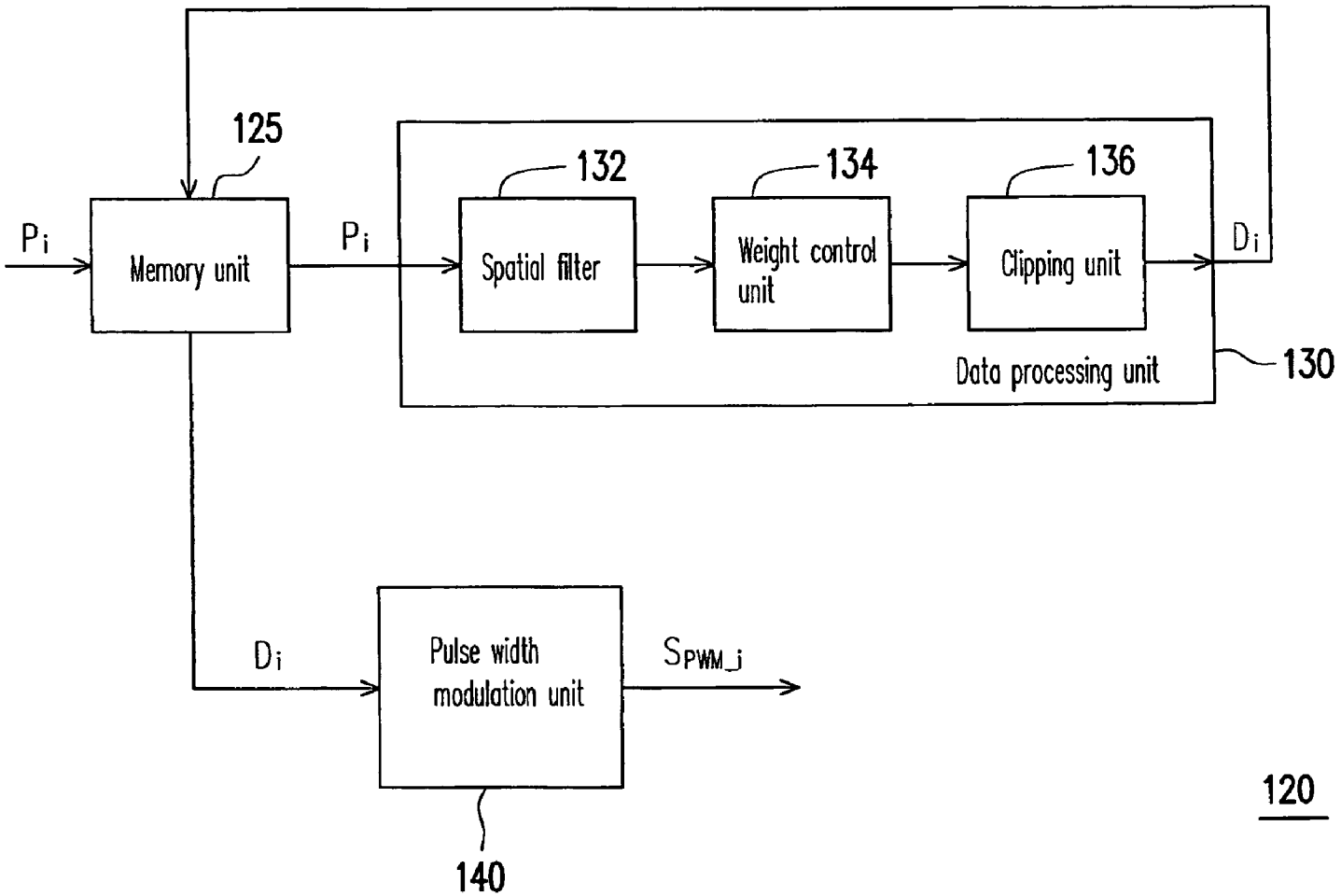
FIG. 3 is a detailed circuit block diagram of a driving circuit 120 according to an embodiment of the present invention.

A detailed circuit block diagram of a driving circuit 120 is further shown in FIG. 3, so that those of ordinary skills in the art can implement the present invention through the teaching of this embodiment. FIG. 3 is a detailed circuit block diagram of the driving circuit 120 according to an embodiment of the present invention. Referring to FIG. 3, the driving circuit 120 includes a memory unit 125, a data processing unit 130, and a pulse width modulation unit 140. The memory unit 125 receives the $i^{th}$ controlling data $P_i$, for storing the $1^{st}$ to the $25^{th}$ controlling data. The data processing unit 130 reads the controlling data in the memory unit, and performs a signal compensation on the $i^{th}$ controlling data, so as to generate an $i^{th}$ driving data, which is expressed as $D_i$.

The data processing unit 130 stores the $i^{th}$ driving data $D_i$ generated by the $i^{th}$ controlling data $P_i$ back to the memory unit 125 after being processed by the signal compensation. Next, the pulse width modulation unit 140 reads the $i^{th}$ driving data $D_i$, and generates an $i^{th}$ PWM signal $S_{PWM_i}$. The duty cycle of the $i^{th}$ PWM signal $S_{PWM_i}$ is, for example, the same or proportional to the $i^{th}$ driving data $D_i$.

The PWM signal $S_{PWM_i}$ output by the pulse width modulation unit 140 in the driving circuit 120 is used to drive the LEDs in the $i^{th}$ luminance-controlling block. As the luminance of the LED is proportion to the duty cycle of the PWM signal, the luminance of the LEDs in the $i^{th}$ luminance-controlling block is controlled by the ich driving data $D_i$, thereby controlling the luminance of the $i^{th}$ luminance-controlling block.

Figure 4:
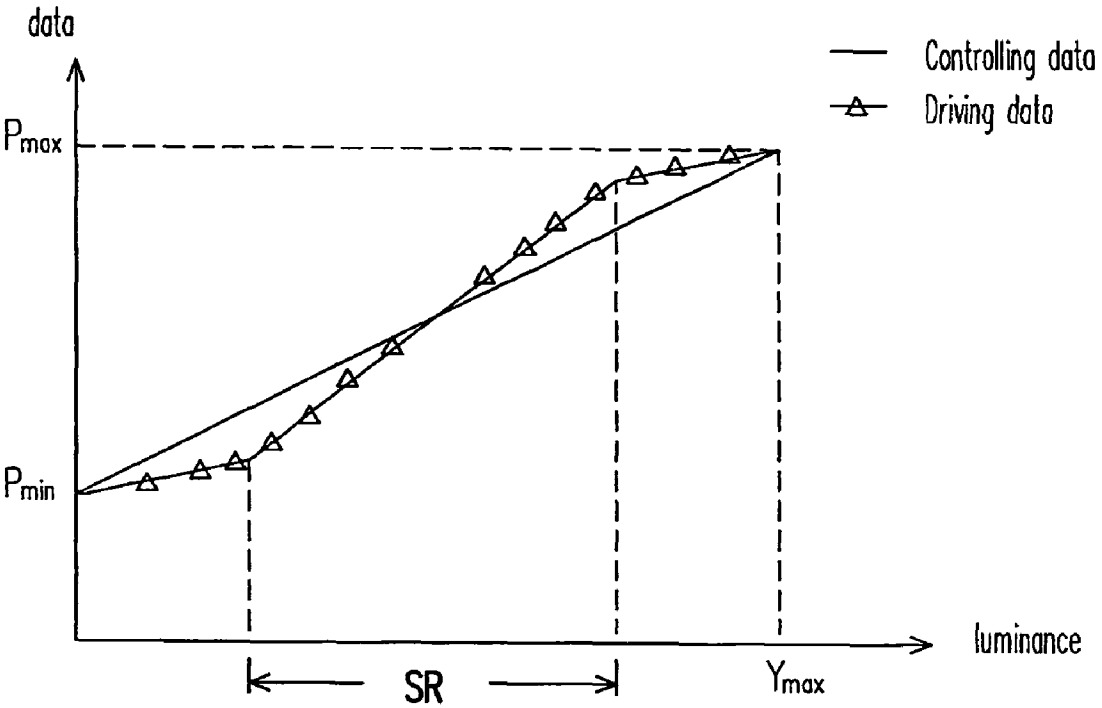
FIG. 4 is a distribution graph of luminance and data according to an embodiment of the present invention.

In this embodiment, if the luminance of the luminance-controlling block is controlled by the controlling data or the driving data, a distribution graph of luminance and data can be obtained. FIG. 4 is a distribution graph of luminance and data according to an embodiment of the present invention. Referring to FIG. 4, a solid line indicates the relationship of the controlling data and the luminance, and a triangular solid line indicates the relationship of the driving data and the luminance. It can be known from the embodiment that, if the duty cycle of the PWM signal is determined by the controlling data output by the calculation unit 110, and the LEDs of the luminance-controlling block are driven by the PWM signal, the controlling data will be in a linear relationship with the luminance, as shown by the solid line in FIG. 4. If the duty cycle of the PWM signal is determined by the driving data output by the data processing unit 130, and the LEDs of the luminance-controlling block are driven by the PWM signal, the slope of the linear relationship in special region will be increased, that is to say, the luminance of the initially lighter part in the luminance-controlling block will be increased, and the luminance of the initially darker part will be reduced. Therefore, in the whole display frame, the frame contrast will be improved.

The signal compensation has various implementation manners, for example, finding out the driving data $D_i$ by the controlling data $P_i$ by means of lookup table, amplifying or minifying the controlling data $P_i$ by a weight, or filtering the controlling data $P_i$ by spatial filter. In this embodiment, the signal compensation is implemented by spatial filter, however, those of ordinary skills in the art should know that the manner of the signal compensation is not limited to this.

The data processing unit 130 in FIG. 3 includes, for example, a spatial filter 132 for performing the spatial filtering process on the $i^{th}$ controlling data. The spatial filtering process is accomplished by, for example, using the $i^{th}$ controlling data and the controlling data corresponding to a plurality of luminance-controlling blocks neighboring the $i^{th}$ luminance-controlling block. And the method of actually applying the spatial filter 132 is described as follows.

Firstly, a one-dimensional filter matrix is stored in the spatial filter 132, which is expressed as F=[−A 2A −A], and the $i^{th}$ driving data $D_i$ obtained from the $i^{th}$ controlling data after the spatial filtering process has a value of $D_i=(-A)\times P_{i-1}+2A\times P_i+(-A)\times P_{i+1}$, in which, A is any positive real number. Taking the luminance-controlling block 203 in FIG. 2 as an example, the $i^{th}$ controlling data $P_i$ is, for example, the controlling data corresponding to the luminance-controlling block 203, the $i-1^{th}$ controlling data $P_{i-1}$ is, for example, the controlling data corresponding to the luminance-controlling block 202, and the $i+1^{th}$ controlling data $P_{i+1}$ is, for example, the controlling data corresponding to the luminance-controlling block 204. As the controlling data $P_{i-1}$ and $P_{i+1}$ corresponding to the luminance-controlling blocks 202 and 204 are multiplied by −A, and the controlling data corresponding to the luminance-controlling block 203 is multiplied by +2A. Therefore, the $i^{th}$ driving data $D_i$ obtained after the spatial filtering process can amplify the difference between luminance of the luminance-controlling block 203 and surrounding luminance, and thus the frame contrast is increased.

Additionally, the filter matrix F in the spatial filter 132 is a one-dimensional filter matrix. And a two-dimensional filter matrix can also be used in this embodiment, such as $$F=\begin{bmatrix} -A & -A & -A \\ -A & +C\cdot A & -A \\ -A & -A & -A \end{bmatrix},$$

in which, A and C are any positive real number.

The driving data (expressed as $D_{x,y}$) obtained from the controlling data (expressed as $P_{x,y}$) corresponding to the luminance-controlling block (expressed as $R_{x,y}$) at the $x^{th}$ row and the $y^{th}$ column in the 25 luminance-controlling blocks after the spatial filtering process has a value of $$D_{x,y}=(-A)\times P_{x-1,y-1}+(-A)\times P_{x-1,y}+(-A)\times P_{x-1,y+1}+(-A)\times P_{x,y-1}+C\times A\times P_{x,y}+(-A)\times P_{x,y+1}+(-A)\times P_{x+1,y-1}+(-A)\times P_{x+1,y}+(-A)\times P_{x+1,y+1}.$$

Taking the luminance-controlling block 213 in FIG. 2 as an example, the controlling data $P_{x,y}$ is, for example, the controlling data corresponding to the luminance-controlling block 213, the controlling data $P_{x-1,y-1}$ is, for example, the controlling data corresponding to the luminance-controlling block 207, the controlling data $P_{x-1,y}$ is, for example, the controlling data corresponding to the luminance-controlling block 208, the controlling data $P_{x-1,y+1}$ is, for example, the controlling data corresponding to the luminance-controlling block 209, the controlling data $P_{x,y-1}$ is, for example, the controlling data corresponding to the luminance-controlling block 212, the controlling data $P_{x,y-1}$ is, for example, the controlling data corresponding to the luminance-controlling block 214, the controlling data $P_{x+1,y-1}$ is, for example, the controlling data corresponding to the luminance-controlling block 217, the controlling data $P_{x+1,y}$ is, for example, the controlling data corresponding to the luminance-controlling block 218, the controlling data $P_{x+1,y+1}$ is, for example, the controlling data corresponding to the luminance-controlling block 219. Additionally, those of ordinary skills in the art can deduce that the form the filter matrix can also be F=[−A 0 2A 0 −A] or $$F=\begin{bmatrix} 0 & -A & 0 \\ -A & +C\cdot A & -A \\ 0 & -A & 0 \end{bmatrix},$$

and so on, and the implementation manners are similar to the above.

Referring to FIG. 3 again, the data processing unit 130 further includes, for example, a weight control unit 134 and a clipping unit 136. The $i^{th}$ driving data $D_i$ output by the weight control unit 134 spatial filter is output after being multiplied by a weight, so as to adjust each controlling data. The clipping unit 136 determines whether the adjusted $i^{th}$ driving data $D_i$ exceeds a saturation value or not, when the $i^{th}$ driving data exceeds the saturation value, the $i^{th}$ driving data $D_i$ is adjusted to the saturation value. The saturation value is, for example, the controlling data corresponding to the maximum luminance data $Y_{max}$.

The embodiment of FIG. 3 is not intended to limit the present invention, those of ordinary skills in the art should know that, the data processing unit 130 can merely include one or two elements, for example, the data processing unit 130 merely includes a spatial filter 132, for performing spatial filter on the controlling data $P_i$. The data processing unit 130 can also merely include the spatial filter 132 and the weight control unit 134, for performing the spatial filter and weight control on the controlling data $P_i$. Additionally, the data processing unit 130 can further merely include the weight control unit 134, for performing the weight control on the controlling data $P_i$.

Figure 5:
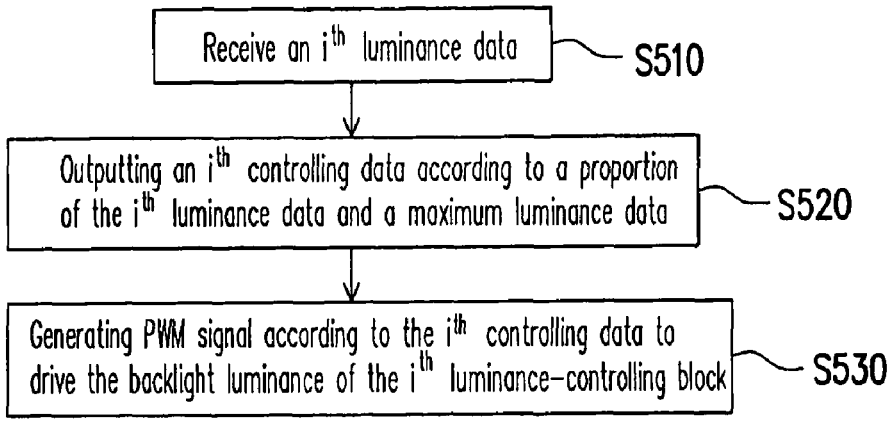
FIG. 5 is a flow chart of the steps of a method for controlling backlight according to an embodiment of the present invention.

A method for controlling backlight can be concluded from the above embodiment, the flow chart thereof is as shown in FIG. 5. FIG. 5 is a flow chart of the steps of the method for controlling backlight according to an embodiment of the present invention. Referring to FIGS. 1 and 5, firstly, the calculation unit 110 receives the $i^{th}$ luminance data $Y_i$ (Step S510). Next, the calculation unit 110 outputs the $i^{th}$ controlling data $P_i$ according to a proportion of the $i^{th}$ luminance data $Y_i$ and the maximum luminance data $Y_{max}$ (Step S520). Finally, the driving circuit 120 generates the PWM signal $S_{PWM_i}$ according to the $i^{th}$ controlling data $P_i$, so as to drive the backlight luminance of the $i^{th}$ luminance-controlling block (Step S530).

Figure 6:
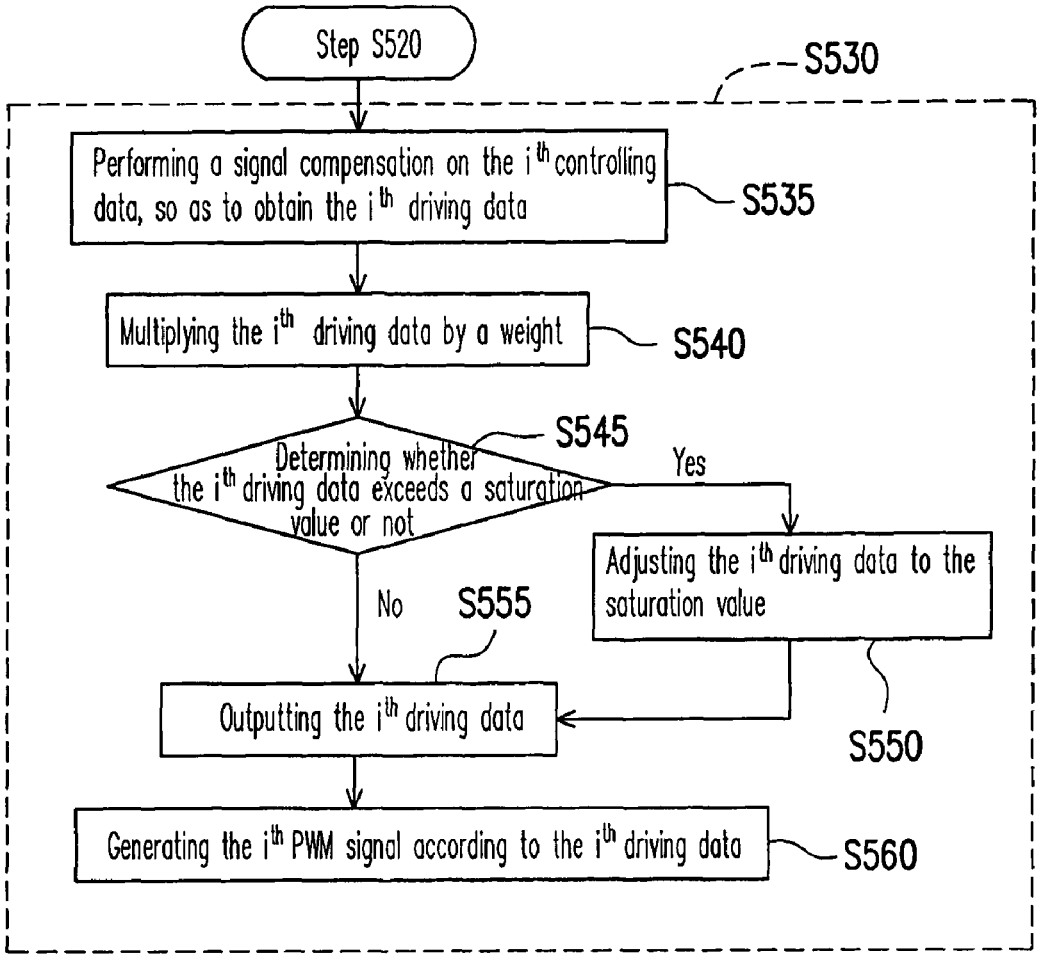
FIG. 6 is a flow chart of the sub-steps of Step S530 according to an embodiment of the present invention.

It can be known from the block diagram of the driving circuit 120 in FIG. 3 that, Step S530 further includes a plurality of sub-steps, as shown in FIG. 6. FIG. 6 is a flow chart of the sub-steps of Step S530 according to an embodiment of the present invention. Referring to FIGS. 3 and 6, firstly, the data processing unit performs a signal compensation on the $i^{th}$ controlling data $P_i$, so as to obtain the $i^{th}$ driving data $D_i$ (Step S535), and the signal compensation is, for example, a spatial filtering process. Next, the weight control unit 134 multiplies the $i^{th}$ driving data $D_i$ by a weight (Step S540). Then, the clipping unit determines whether the $i^{th}$ driving data $D_i$ exceeds a saturation value (Step S545). If the $i^{th}$ driving data $D_i$ exceeds the saturation value, the $i^{th}$ driving data $D_i$ is adjusted to the saturation value (Step S550). If the $i^{th}$ driving data $D_i$ dose not exceed the saturation value, the $i^{th}$ driving data $D_i$ is output (Step S555). Finally, the $i^{th}$ PWM signal is generated according to the $i^{th}$ driving data $D_i$ (Step S560), in which the duty cycle of the $i^{th}$ PWM signal is determined by the $i^{th}$ driving data, so as to drive the backlight luminance of the $i^{th}$ luminance-controlling block.

In the above embodiment, as the backlight module is divided into 25 luminance-controlling blocks, 25 pins are needed to transmit the PWM signals to the backlight module, so as to drive the LEDs in the backlight module. However, when the embodiment is actually implemented, since the frame is divided into more luminance-controlling blocks, or each luminance-controlling block in the backlight module is required to individually control and drive red, green, and blue LEDs, the required pins will be significantly increased. For example, if the frame is divided into 64 luminance-controlling blocks, and the backlight module is required to individually control red, green, and blue LEDs, in such a condition, the required signal lines will be sharply increased to 192. In order to solve the problem, another embodiment of the driving circuit 120 is further provided to allow those of ordinary skills in the art to implement the present invention through the teaching of this embodiment.

Figure 7:
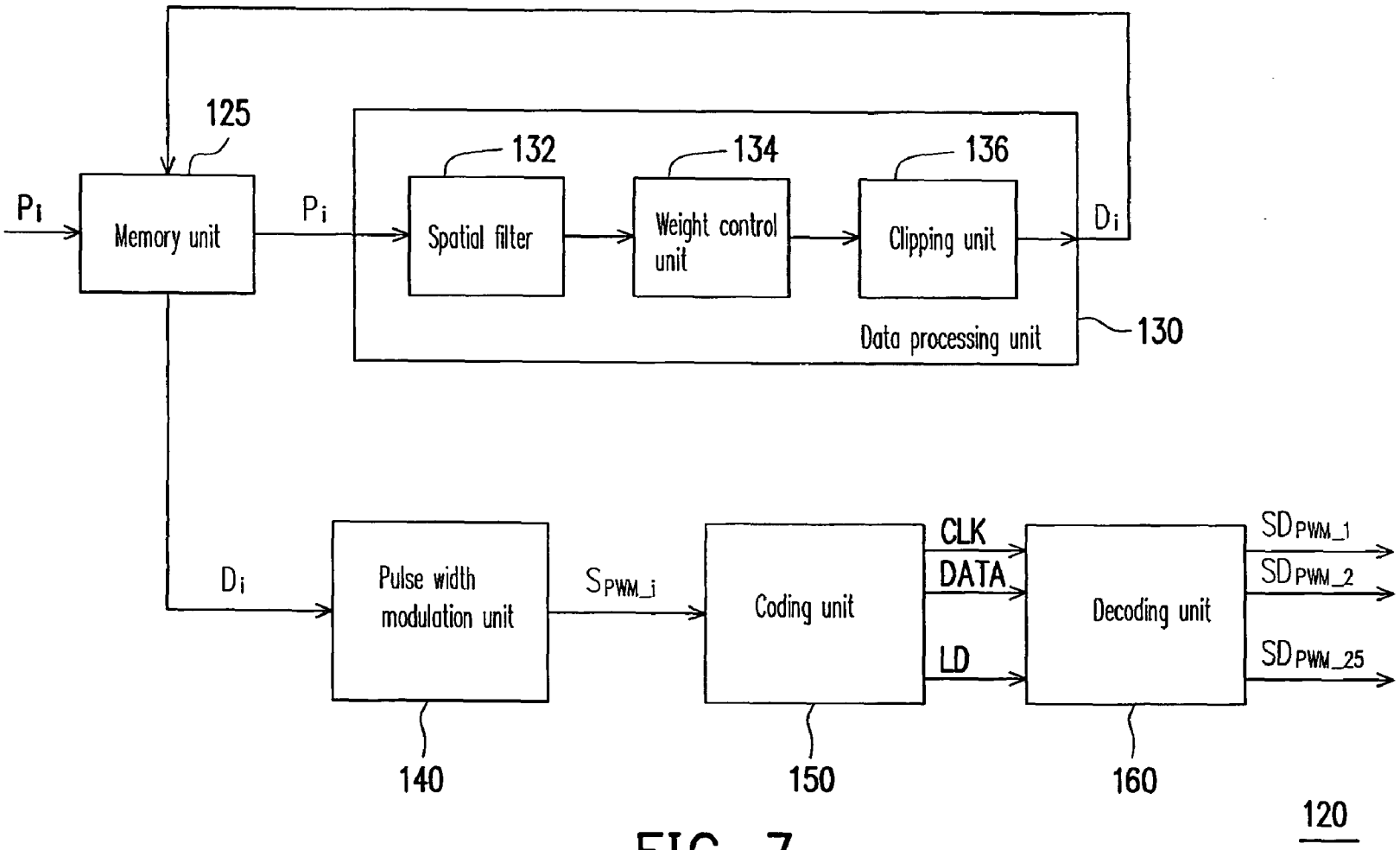
FIG. 7 is a detailed circuit block diagram of a driving circuit 120 according to another embodiment of the present invention.

FIG. 7 is a detailed circuit block diagram of a driving circuit 120 according to another embodiment of the present invention. Referring to FIG. 7, the driving circuit 120 includes a memory unit 125, a data processing unit 130, a pulse width modulation unit 140, a coding unit 150, and a decoding unit 160. The memory unit 125, the data processing unit 130, and the pulse width modulation unit 140 are the same as the embodiment in FIG. 3 and thus will not be described in detail herein. In this embodiment, the coding unit 150 receives the PWM signal $S_{PWM_i}$ output by the pulse width modulation unit, as the frame is divided into 25 luminance-controlling blocks, the coding unit 150 receives 25 PWM signals. The coding unit 150 generates a clock signal CLK, a data signal DATA, and a read trigger signal LD after performing a sampling and coding process on the 25 PWM signals. The decoding unit 160 receives and decodes the clock signal CLK, the data signal DATA, and the read trigger signal LD, so as to obtain the 25 decoded PWM signals (expressed as $SD_{PWM_1}$, $SD_{PWM_2}$, . . . , $SD_{PWM_25}$) by reduction. In order to solve the problem of having excessive pins, the decoding unit 160 in FIG. 7 can be implemented in the backlight module, and thus merely three pins are required by the coding unit 150 to transmit the signals.

Figure 8:
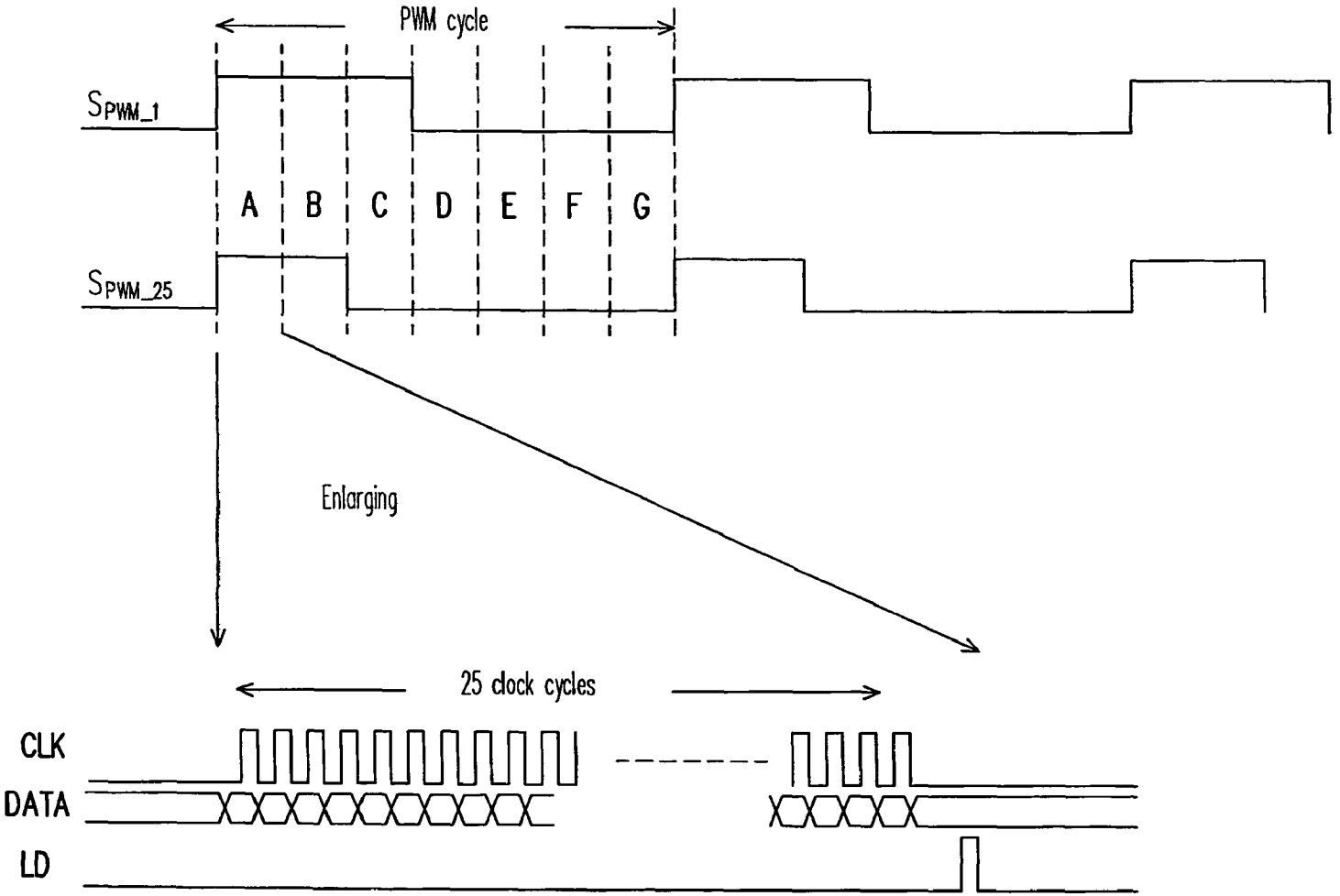
FIG. 8 is a signal oscillogram according to another embodiment of the present invention.

In this embodiment, the sampling and coding process adapted by the coding unit 150 is illustrated, for example, in FIG. 8. Referring to FIG. 8, the PWM signals $S_{PWM_1}$, . . . , $S_{PWM_25}$, the clock signal CLK, the data signal DATA, and the read trigger signal LD are shown respectively. The sampling and coding process is performed by, for example, dividing the cycle of the PWM signal into N timing segments (for example, 7 timing segments A, B, . . . , G in FIG. 8). In a $j^{th}$ timing segment (for example, the timing segment A in FIG. 8), the clock signal CLK includes 25 clock cycles (i.e., includes 25 transition points). The 25 PWM signals in the timing segment are respectively sampled once by the 25 transition points in the timing segment A, so as to generate 25 sampling values. Then, the 25 sampling values sequentially form the data signal DATA. Finally, after 25 transition points, a pulse is formed in the read trigger signal. By the same way in the subsequent timing segments B, . . . , G, each PWM signal is sampled once, and the sampling values of each PWM signal sequentially form the data signal DATA.

Figure 9:
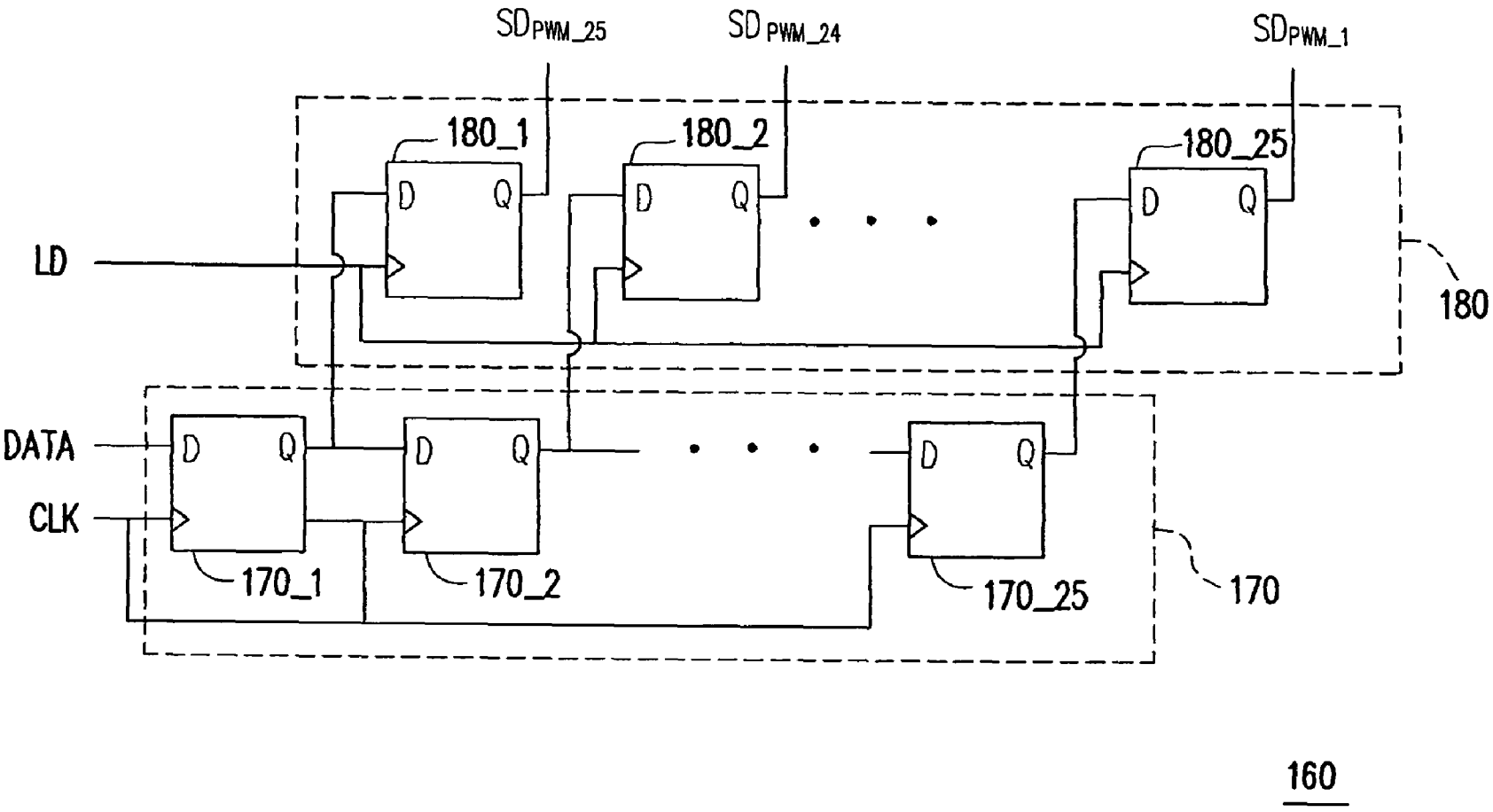
FIG. 9 is a circuit block diagram of a decoding unit 160 according to an embodiment of the present invention.

According to the sampling and coding process, the circuit diagram of the decoding unit 160 is, for example, as shown in FIG. 9. FIG. 9 is a circuit block diagram of the decoding unit 160 according to an embodiment of the present invention. Referring to FIG. 9, the decoding unit 160 includes a register circuit 170 and an output circuit 180. The register circuit 170 includes 25 first D-type flip-flops 170_1-170_25, the output circuit 180 includes 25 second D-type flip-flops 180_1-180_25. The coupling relationship of the elements in the register circuit 170 and the output circuit 180 is as shown in FIG. 9.

In the condition of having no transmission delay, the register circuit 170 receives the clock signal CLK and the data signal DATA shown in FIG. 8 in the timing segment A in FIG. 8. When the register circuit 170 receives the cycle of the $1^{st}$ clock signal CLK and the $1^{st}$ sampling value in the data signal DATA, the D-type flip-flop 170_1 latches the $1^{st}$ sampling value, the level of a Q output end is maintained at the $1^{st}$ sampling value, and the $1^{st}$ sampling value is the sampling value of the PWM signal $S_{PWM_1}$ in the timing segment A. Next, when the register circuit 170 receives the cycle of the $2^{nd}$ clock signal CLK and the $2^{nd}$ sampling value in the data signal DATA, the D-type flip-flop 170_1 latches the $2^{nd}$ sampling value, the level of the Q output end is maintained at the $2^{nd}$ sampling value, the D-type flip-flop 170_2 latches the $1^{st}$ sampling value, the level of the Q output end is maintained at the $1^{st}$ sampling value. The rest can be deduced by analog, when the register circuit 170 receives the cycle of the $25^{th}$ clock signal CLK, the levels of the Q output ends of the D-type flip-flops 170_1-170_25 are sequentially the sampling values of the PWM signals $S_{PWM_25}$-$S_{PWM_1}$ in the timing segment A.

Next, it can be known from FIG. 8, a pulse is formed in the read trigger signal, the pulse triggers the D-type flip-flops 180_1-180_25 in the output circuit 180 simultaneously, so that the Q output ends of the D-type flip-flops 180_1-180_25 output the sampling values of the PWM signals $S_{PWM_25}$-$S_{PWM_1}$ in timing segment A, and thus the decoded PWM signal $SD_{PWM_1}$-$SD_{PWM_25}$ output by the decoding circuit 160 in each timing segment can reduce out the PWM signals $S_{PWM_1}$-$S_{PWM_25}$.

Figure 10:
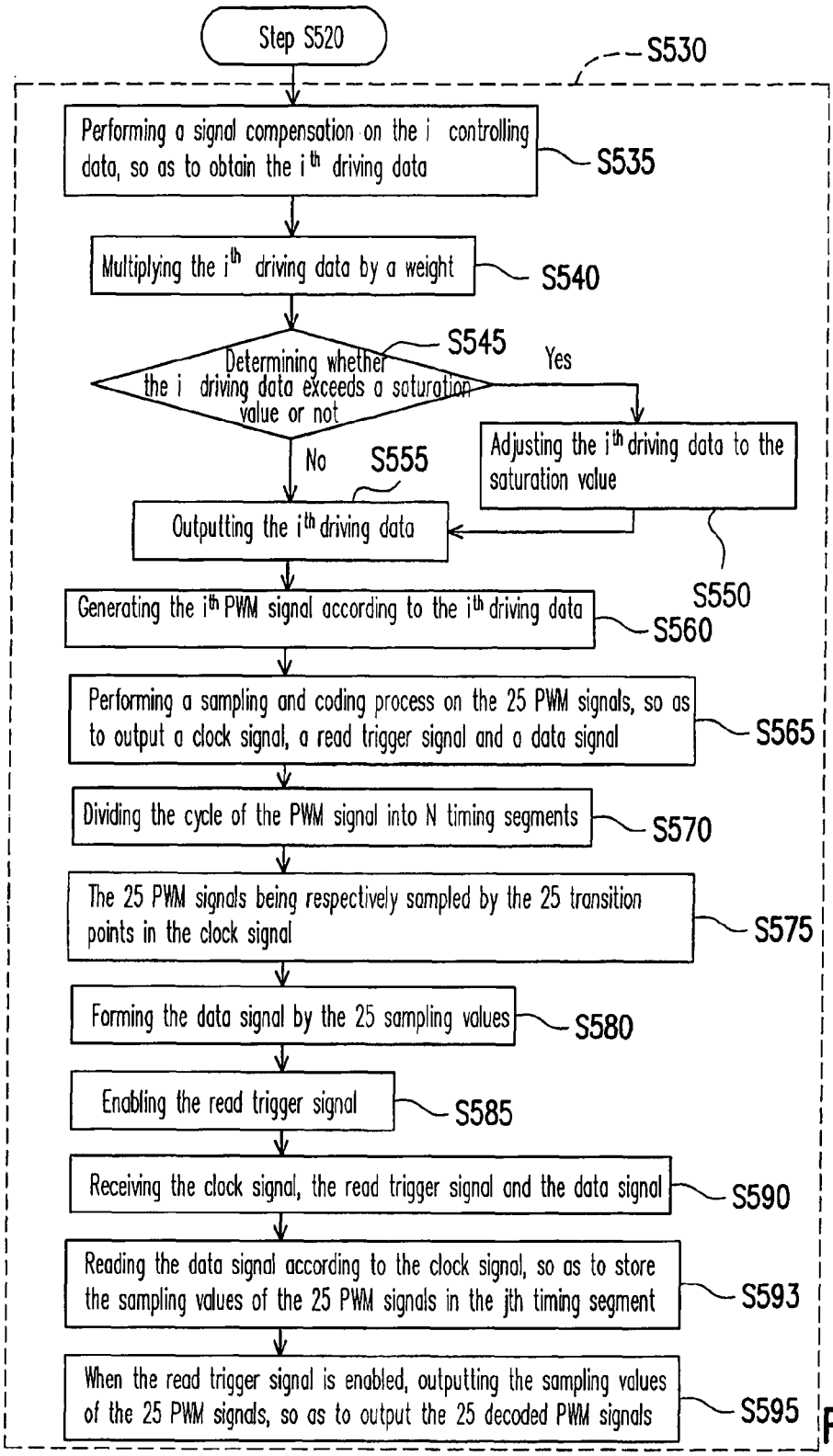
FIG. 10 is a flow chart of the sub-steps of Step S530 according to another embodiment of the present invention.

According to the embodiments in FIGS. 7-9, Step S530 in FIG. 5 further includes a plurality of sub-steps, as shown in FIG. 10. FIG. 10 is a flow chart of the sub-steps of Step S530 according to another embodiment of the present invention. Referring to FIGS. 7-10, Steps S535-S560 are the same as the steps in FIG. 6, and thus will not be described in detail herein. After Step S560, the coding unit 150 perform a sampling and coding process on the 25 PWM signals $S_{PWM_1}$-$S_{PWM_25}$, so as to output the clock signal CLK, the read trigger signal LD and the data signal DATA (Step S565). Next, the cycle of the PWM signal is divided into N timing segments (Step S570). In the $j^{th}$ timing segment, sample 25 PWM signals $S_{PWM_1}$-$S_{PWM_25}$ are respectively sampled once by the 25 transition points in the clock signal CLK, so as to generate 25 sampling values (Step S575), and form the data signal DATA from the 25 sampling values (Step S580). Subsequent to the 25 transition points, the read trigger signal LD will be enabled (Step S585).

Next, the decoding unit 160 receives the clock signal CLK, the read trigger signal LD and the data signal DATA (Step S590). Then, the decoding unit 160 reads the data signal DATA according to the clock signal CLK, so as to store the sampling values of the 25 PWM signals $S_{PWM_1}$-$S_{PWM_25}$ in the $j^{th}$ timing segment (Step S593). When the read trigger signal LD is enabled, the decoding unit 160 outputs the sampling values of the 25 PWM signals $S_{PWM_1}$-$S_{PWM_25}$, so as to output the 25 decoded PWM signals $SD_{PWM_1}$-$SD_{PWM_25}$ (Step S595).

In view of the above, it is concluded that the present invention has the following advantages.

1. As the driving circuit according to this embodiment respectively controls and drives various luminance-controlling blocks, the frame contrast is increased and the power consumption is reduced.

2. As a data processing unit is used to compensate the controlling data in this embodiment, the difference between various luminance-controlling blocks can be further distinguished and the frame contrast is further increased.

3. As a coding unit and a decoding unit are used in this embodiment, the pins used in the circuit are reduced, so as to simplify the complexity of the circuit.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for controlling backlight, adapted for driving a backlight module of a display panel, wherein the backlight module comprises M luminance-controlling blocks, and an $i^{th}$ luminance-controlling block corresponds to an $i^{th}$ luminance data, comprising:

a calculation unit, receiving the $i^{th}$ luminance data to output an $i^{th}$ controlling data according to the proportion of the $i^{th}$ luminance data and a maximum luminance data, wherein M and i are natural numbers, and i<=M; and a driving circuit, receiving the $i^{th}$ controlling data to determine and drive the luminance of the $i^{th}$ luminance-controlling block.

2. The apparatus for controlling backlight as claimed in claim 1, wherein the driving circuit comprises:

a memory unit, comprising M memory blocks, for storing the first through the $M^{th}$ controlling data; and a data processing unit, for performing signal compensation on the $i^{th}$ controlling data, so as to get an $i^{th}$ driving data to determine the luminance of the $i^{th}$ luminance-controlling block.

3. The apparatus for controlling backlight as claimed in claim 2, wherein the data processing unit comprises:

a spatial filter, for performing a spatial filtering process on the $i^{th}$ controlling data, wherein the spatial filtering process is accomplished by the $i^{th}$ controlling data and a plurality of controlling data, the plurality of controlling data corresponds to a plurality of luminance-controlling blocks neighboring the $i^{th}$ luminance-controlling block.

4. The apparatus for controlling backlight as claimed in claim 3, wherein the $i^{th}$ controlling data is expressed as $P_i$, the spatial filter has a filter matrix expressed as F=[−A 2A −A], the $i^{th}$ driving data obtained from the $i^{th}$ controlling data after the spatial filtering process is expressed as $D_i$, and has a value of $D_i=(-A)\times P_{i-1}+2A\times P_i+(-A)\times P_{i+1}$, wherein, A is a positive real number.

5. The apparatus for controlling backlight as claimed in claim 3, wherein the $i^{th}$ controlling data is expressed as $P_i$, the spatial filter has a filter matrix expressed as F=[−A 0 2A 0 −A], the $i^{th}$ driving data obtained from the $i^{th}$ controlling data after the spatial filtering process is expressed as $D_i$, and has a value of $D_i=(-A)\times P_{i-2}+2A\times P_i+(-A)\times P_{i+2}$, wherein, A is a positive real number.

6. The apparatus for controlling backlight as claimed in claim 3, wherein a luminance-controlling block at the $x^{th}$ row and the $y^{th}$ column in the M luminance-controlling blocks is expressed as $R_{x,y}$, a controlling data corresponding to the luminance-controlling block $R_{x,y}$ is expressed as $P_{x,y}$, a driving data corresponding to the luminance-controlling block $R_{x,y}$ is expressed as $D_{x,y}$, the spatial filter has a filter matrix, expressed as $$F=\begin{bmatrix} -A & -A & -A \\ -A & +C\cdot A & -A \\ -A & -A & -A \end{bmatrix},$$

and the driving data $D_{x,y}$ obtained from the controlling data $P_{x,y}$ after the spatial filtering process has a value of $D_{x,y}=(-A)\times P_{x-1,y-1}+(-A)\times P_{x-1,y}+(-A)\times P_{x-1,y+1}+(-A)\times P_{x,y-1}+C\times A\times P_{x,y}+(-A)\times P_{x,y+1}+(-A)\times P_{x+1,y-1}+(-A)\times P_{x+1,y}+(-A)\times P_{x+1,y+1}$, wherein, A and C are positive real numbers.

7. The apparatus for controlling backlight as claimed in claim 3, wherein a luminance-controlling block at the $x^{th}$ row and the $y^{th}$ column in the M luminance-controlling blocks is expressed as $R_{x,y}$, a controlling data corresponding to the luminance-controlling block $R_{x,y}$ is expressed as $P_{x,y}$, a driving data corresponding to the luminance-controlling block $R_{x,y}$ is expressed as $D_{x,y}$, the spatial filter has a filter matrix, expressed as $$F=\begin{bmatrix} 0 & -A & 0 \\ -A & +C\cdot A & -A \\ 0 & -A & 0 \end{bmatrix},$$

and the driving data $D_{x,y}$ obtained from the controlling data $P_{x,y}$ after the spatial filtering process has a value of $D_{x,y}=(-A)\times P_{x-1,y}+(-A)\times P_{x,y-1}+C\times A\times P_{x,y}+(-A)\times P_{x,y+1}+(-A)\times P_{x+1,y}$, wherein, A and C are positive real numbers.

8. The apparatus for controlling backlight as claimed in claim 2, wherein the data processing unit comprises:

a weight control unit, for multiplying the $i^{th}$ driving data by a weight.

9. The apparatus for controlling backlight as claimed in claim 2, wherein the data processing unit comprises:

a clipping unit, for adjusting the $i^{th}$ driving data when the $i^{th}$ driving data exceeds a saturation value, wherein the saturation value corresponds to the maximum luminance data.

10. The apparatus for controlling backlight as claimed in claim 2, wherein the driving circuit further comprises:

a pulse width modulation (PWM) unit, for generating an $i^{th}$ PWM signal, wherein a duty cycle of the $i^{th}$ PWM signal is determined according to the $i^{th}$ driving data.

11. The apparatus for controlling backlight as claimed in claim 10, wherein the driving circuit further comprises:

a coding unit, for performing a sampling and coding process on the M PWM signals and outputting a clock signal, a read trigger signal and a data signal;

wherein, a cycle of the PWM signal is divided into N timing segments by the sampling and coding process, the clock signal at least comprises M transition points in a $j^{th}$ timing segment, in the $j^{th}$ timing segment, the M PWM signals are respectively sampled once by the M transition points in the clock signal, and form the data signal by sampling values of the M PWM signals, and the read trigger signal is enabled subsequent to the M transition points.

12. The apparatus for controlling backlight as claimed in claim 11, wherein the driving circuit further comprises:

a decoding unit, receiving the clock signal, the read trigger signal and the data signal, for sequentially storing the data signal according to the clock signal in the $j^{th}$ timing segment, and outputting M decoded PWM signals when the read trigger signal is enabled.

13. The apparatus for controlling backlight as claimed in claim 12, wherein the decoding unit comprises:

a register circuit, comprising M first D-type flip-flops, wherein the first D-type flip-flops respectively comprises a D input end, a Q output end, and a clock input end, the clock input ends of the first D-type flip-flops receive the clock signal, the D input end of a $1^{st}$ first D-type flip-flop receives the data signal, the D input end of a $k+1^{th}$ first D-type flip-flop is coupled to the Q output end of a $k^{th}$ first D-type flip-flop, wherein k is a nature number, and k<=M; and an output circuit, comprising M second D-type flip-flops, wherein the second D-type flip-flops respectively comprises a D input end, a Q output end, and a clock input end, the clock input ends of the second D-type flip-flops receive the read trigger signal, the D input end of a $k^{th}$ second D-type flip-flop is coupled to the Q output end of the $k^{th}$ first D-type flip-flop, and the Q output end of the $k^{th}$ second D-type flip-flop outputs a $k^{th}$ decoded PWM signal.

14. The apparatus for controlling backlight as claimed in claim 1, wherein the maximum controlling data is expressed as $P_{max}$, the minimum controlling data is expressed as $P_{min}$, the maximum luminance data expressed as $Y_{max}$, the $i^{th}$ luminance data is expressed as $Y_i$, and the proportion is:

$$P_i=P_{max}-(P_{max}-P_{min})\times(Y_{max}-Y_i)/Y_{max}.$$

15. A method for controlling backlight luminance, adapted for driving a backlight module of a display panel according to M luminance data, wherein the backlight module comprises M luminance-controlling blocks, and an $i^{th}$ luminance-controlling block corresponds to an $i^{th}$ luminance data, comprising:

providing a maximum luminance data;

receiving the $i^{th}$ luminance data;

outputting an $i^{th}$ controlling data according to a proportion of the $i^{th}$ luminance data and the maximum luminance data, wherein M and i are natural numbers, and i<=M; and determining and driving the backlight luminance of the $i^{th}$ luminance-controlling block according to the $i^{th}$ controlling data.

16. The method for controlling backlight as claimed in claim 15, wherein the step of determining and driving the backlight luminance of the $i^{th}$ luminance-controlling block according to the $i^{th}$ controlling data comprises:

performing a signal compensation on the $i^{th}$ controlling data, so as to obtain an $i^{th}$ driving data to determine the luminance of the $i^{th}$ luminance-controlling block.

17. The method for controlling backlight as claimed in claim 16, wherein the signal compensation is a spatial filtering process, the spatial filtering process is accomplished by the $i^{th}$ controlling data and a plurality of controlling data, the plurality of controlling data corresponds to a plurality of luminance-controlling blocks neighboring the $i^{th}$ luminance-controlling block.

18. The method for controlling backlight as claimed in claim 16, wherein the $i^{th}$ controlling data is expressed as $P_i$, the spatial filtering process is expressed as F=[−A 2A −A] by a filter matrix, the $i^{th}$ driving data obtained from the $i^{th}$ controlling data after the spatial filtering process is expressed as $D_i$, and has a value of $D_i=(-A)\times P_{i-1}+2A\times P_i+(-A)\times P_{i+1}$, wherein, A is a positive real number.

19. The method for controlling backlight as claimed in claim 16, wherein the $i^{th}$ controlling data is expressed as $P_i$, the spatial filtering process is expressed as F=[−A 0 2A 0 −A] by a filter matrix, the $i^{th}$ driving data obtained from the $i^{th}$ controlling data after the spatial filtering process is expressed as $D_i$, and has a value of $D_i=(-A)\times P_{i-2}+2A\times P_i+(-A)\times P_{i+2}$, wherein, A is a positive real number.

20. The method for controlling backlight as claimed in claim 16, wherein a luminance-controlling block at the $x^{th}$ row and the $y^{th}$ column in the M luminance-controlling blocks is expressed as $R_{x,y}$, a controlling data corresponding to the luminance-controlling block $R_{x,y}$ is expressed as $P_{x,y}$, a driving data corresponding to the block $R_{x,y}$ is expressed as $D_{x,y}$, the spatial filtering process is expressed as $$F=\begin{bmatrix} -A & -A & -A \\ -A & +C\cdot A & -A \\ -A & -A & -A \end{bmatrix}$$

by a filter matrix, and the driving data $D_{x,y}$ obtained from the controlling data $P_{x,y}$ after the spatial filtering process has a value of $Di=(-A)\times P_{x-1,y-1}+(-A)\times P_{x-1,y}+(-A)\times P_{x-1,y+1}+(-A)\times P_{x,y-1}+C\times A\times P_{x,y}+(-A)\times P_{x,y+1}+(-A)\times P_{x+1,y-1}+(-A)\times P_{x+1,y}+(-A)\times P_{x+1,y+1}$, wherein, A and C are positive real numbers.

21. The method for controlling backlight as claimed in claim 16, wherein a luminance-controlling block at the $x^{th}$ row and the $y^{th}$ column in the M luminance-controlling blocks is expressed as $R_{x,y}$, a controlling data corresponding to the luminance-controlling block $R_{x,y}$ is expressed as $P_{x,y}$, a driving data corresponding to the luminance-controlling block $R_{x,y}$ is expressed as $D_{x,y}$, the spatial filtering process is expressed as $$F=\begin{bmatrix} 0 & -A & 0 \\ -A & +C\cdot A & -A \\ 0 & -A & 0 \end{bmatrix}$$

by a filter matrix, and the driving data $D_{x,y}$ obtained from the controlling data $P_{x,y}$ after the spatial filtering process has a value of $Di=(-A)\times P_{x-1,y}+(-A)\times P_{x,y-1}+C\times A\times P_{x,y}+(-A)\times P_{x+1,y}$, wherein, A and C are positive real numbers.

22. The method for controlling backlight as claimed in claim 16, wherein after the step of performing the signal compensation on the $i^{th}$ controlling data to obtain the $i^{th}$ driving data, the method further comprises:

determining whether the $i^{th}$ driving data exceeds a saturation value or not;

if the $i^{th}$ driving data exceeds the saturation value, adjusting the $i^{th}$ driving data to the saturation value and outputting the $i^{th}$ driving data; and if the $i^{th}$ driving data dose not exceed the saturation value, outputting the $i^{th}$ driving data;

wherein, the saturation value corresponds to the maximum luminance data.

23. The method for controlling backlight as claimed in claim 16, wherein after the step of obtaining the $i^{th}$ driving data, the method further comprises generating an $i^{th}$ PWM signal by using the $i^{th}$ driving data, wherein the duty cycle of the $i^{th}$ PWM signal is determined according to the $i^{th}$ driving data.

24. The method for controlling backlight as claimed in claim 23, wherein after the step of generating the $i^{th}$ PWM signal, the method further comprises performing a sampling and coding process on the M PWM signals, so as to output a clock signal, a read trigger signal, and a data signal.

25. The method for controlling backlight as claimed in claim 24, wherein the sampling and decoding process comprises:

dividing the cycle of the PWM signal into N timing segments, wherein, the clock signal in a $j^{th}$ timing segment at least comprises M transition points;

in the $j^{th}$ timing segment, the M PWM signals are respectively sampled once by the M transition points in the clock signal;

forming the data signal by sampling values of the M PWM signals; and enabling the read trigger signal subsequent to the M transition points.

26. The method for controlling backlight as claimed in claim 25, wherein after performing the sampling and coding process on the M PWM signals, the method further comprises:

in the $j^{th}$ timing segment, receiving the clock signal, the read trigger signal, and the data signal;

according to the clock signal, reading the data signal, and storing the sampling values of the M PWM signals in the $j^{th}$ timing segment;

when the read trigger signal being enabled, outputting the sampling values of the M PWM signals, so as to obtain M decoded PWM signals.

27. The method for controlling backlight as claimed in claim 15, further comprising multiplying the $i^{th}$ driving data by a weight after performing a signal compensation on the $i^{th}$ controlling data, so as to obtain the $i^{th}$ driving data.

28. The method for controlling backlight as claimed in claim 15, wherein the maximum controlling data is expressed as $P_{max}$, the minimum controlling data is expressed as $P_{min}$, the maximum luminance data is expressed as $Y_{max}$, the $i^{th}$ luminance data is expressed as $Y_i$, and the proportion is $$P_i = P_{max} - (P_{max} - P_{min}) \times (Y_{max} - Y_i) / Y_{max}.$$

* * * * *